US005232338A

United States Patent [19]

Vincent de Paul et al.

[11] Patent Number: 5,232,338

[45] Date of Patent: Aug. 3, 1993

[54] BLADE ARRAY FOR TURBOMACHINES COMPRISING SUCTION PORTS IN THE INNER AND/OR OUTER WALL AND TURBOMACHINES COMPRISING SAME

[75] Inventors: Michel Vincent de Paul, Senlis; Francois Detanne, Paris, both of France

[73] Assignee: Gec Alsthom SA, Paris, France

[21] Appl. No.: 759,372

[22] Filed: Sep. 13, 1991

[30] Foreign Application Priority Data

Sep. 13, 1990 [FR] France ..... 90 11336

[51] Int. Cl.[5] ..... F01D 5/06; F01D 5/08; F01D 9/04

[52] U.S. Cl. ..... 415/144; 415/115; 415/116; 415/173.5; 415/173.6; 415/914; 416/92

[58] Field of Search ..... 415/115, 116, 144, 181, 415/914, 170.1, 173.1, 173.5, 173.6, 174.5; 416/90 R, 91, 92

[56] References Cited

U.S. PATENT DOCUMENTS

| | | | |
|---|---|---|---|
| 3,746,462 | 7/1973 | Fukuda | 415/174.5 |
| 3,846,038 | 11/1974 | Carriere et al. | 415/914 |
| 4,146,352 | 3/1979 | Yasugahira et al. . | |
| 4,362,465 | 7/1982 | Riollet et al. . | |

FOREIGN PATENT DOCUMENTS

| | | | |
|---|---|---|---|
| 2135286 | 1/1973 | Fed. Rep. of Germany | 415/914 |
| 8000728 | 1/1980 | France . | |
| 2439157 | 4/1980 | France . | |
| 52-54807 | 4/1977 | Japan . | |
| 0052603 | 3/1982 | Japan | 415/173.1 |
| 1015082 | 4/1983 | U.S.S.R. | 415/914 |
| 1159970 | 6/1985 | U.S.S.R. | 415/173.6 |

*Primary Examiner*—Edward K. Look
*Assistant Examiner*—Christopher M. Verdier
*Attorney, Agent, or Firm*—Sughrue, Mion, Zinn, Macpeak & Seas

[57] ABSTRACT

A blade array for turbomachines comprises blades disposed between an inner wall and an outer wall. The inner wall and/or the outer wall is provided with a suction port near at least some blades. This port has a first end situated along the upper surface in a region of the blade extending from the point of maximum curvature to the neck of the passage between said blade and the adjacent blade. The port enabling the efficiency to be increased is oriented along an isobar line. Its length is such that the second end is spaced from the upper surface of the blade by a distance between one quarter and one half the width of the neck of the inter-blade passage.

5 Claims, 3 Drawing Sheets

BLADE ARRAY FOR TURBOMACHINES COMPRISING SUCTION PORTS IN THE INNER AND/OR OUTER WALL AND TURBOMACHINES COMPRISING SAME

BACKGROUND OF THE INVENTION

1. Field of the invention

The present invention concerns a blade array for turbomachines comprising blades disposed between an inner wall and an outer wall and in which the inner wall and/or the outer wall is provided with a suction port near at least some blades, said port having a first end situated along the upper surface in a region of the blade extending from the point of maximum curvature to the neck of the passage between said blade and the adjacent blade.

Suction ports have been provided in the inner and/or outer wall of such blade arrays to aspirate the boundary layers along the inner and outer wall. Disturbances occur in these layers. See for example the article "Sur les pertes á l'extrémité des aubes de turbine" published in the Brown, Boveri journal in French, November 1941, pages 356 through 361 and in particular FIGS. 2 and 3.

These disturbances are accompanied by significant losses known as secondary losses which affect the efficiency of a blade array in inverse proportion to the blade height/chord ratio.

The Japanese document JP-A-52-54807 published 4 May 1977 describes one example of a blade array with suction ports.

The known ports cross the inter-blade passage and extend from the upper surface of one blade to the lower surface of the adjacent blade.

It has been found that these ports do not achieve any improvement and even increase the losses.

SUMMARY OF THE INVENTION

In one aspect, the invention consists in a blade array for turbomachines comprising blades disposed between an inner wall and an outer wall and in which at least one of the inner wall and the outer wall is provided with a suction port near at least some blades, said port having a first end situated along the upper surface of a blade in a region of the blade extending from the point of maximum curvature of the blade to the neck of the passage between said blade and the adjacent blade, in which blade array the port enabling the efficiency to be increased is oriented along an isobar pressure line and has a length such that the second end is spaced from the upper surface of the blade by a distance between one quarter and one half the width of the neck of the inter-blade passage.

The pressure is constant along the port so that the aspirated fluid will not be blown out of another part of the port as in the known arrays.

In a second aspect, the invention consists in a turbomachine comprising multiple stages each constituted by a stationary blade array followed by a rotary blade array, said blades of an array being disposed between an inner wall and an outer wall, the outer wall of the rotary blade arrays being provided with a sealing packing defining with the facing part of the rotor a plurality of chambers, the outer wall of the stationary blade array being provided with a suction port near at least some blades, said port having a first end situated along the upper surface of a blade in a region extending from the point of maximum curvature of the blade to the neck of the passage between said blade and the adjacent blade, wherein said port is oriented along an isobar pressure line and has a length such that the second end is spaced from the upper surface of said blade by a distance between one quarter and one half the width of the neck of the inter-blade passage, said port being connected to a lower pressure part of the turbomachine.

When the invention is applied to the stationary blade array of a stage the port is connected by a passage to one of the sealing chambers situated in the forward part of the packing of the rotary blade array of the next stage.

When the invention is applied to the rotary blade array of a stage, the bottom wall of the rotary blade array is provided with a suction port near at least some blades, said port having a first end situated along the upper surface of a blade in a region extending from the point of maximum curvature of said blade upper surface to the neck of the passage between said blade and the adjacent blade, said port being oriented along an isobar line and having a length such that the second end is spaced from the upper surface by a distance between one quarter and one half the width of the neck of the inter-blade passage, and said port is connected by a conduit passing upwardly through said blade and discharging on the downstream side of the sealing packing of said blade in one of the final chambers of said packing.

The second end of the port is preferably spaced from the upper surface of the blade by a distance approximating one third the width of the neck of the inter-blade passage.

The present invention will be better understood from the following description.

DETAILED DESCRIPTION OF THE INVENTION

Figure 1:
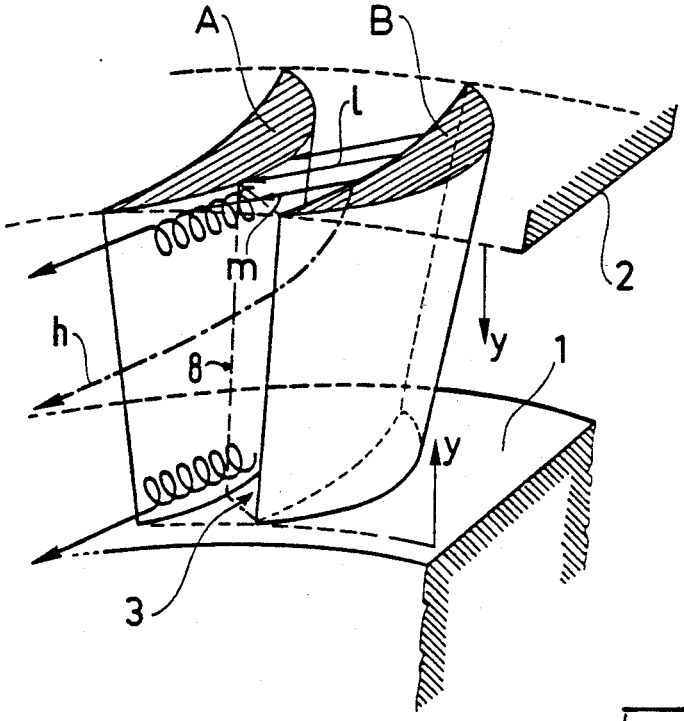
FIG. 1 PRIOR ART
FIG. 1 shows a conventional turbine in axial cross-section.

FIG. 1 shows two blades A and B, each of which has a convex upper surface and a concave lower surface, which blades are part of a ring of blades and which are fixed to an inner wall 1 at the bottom and to an outer wall 2 at the top. The inner wall 1 and the outer wall 2 are usually cylindrical or frustoconical surfaces.

The concave lower surface of the blade B, the convex upper surface of the blade A, the inner wall 1 and the outer wall 2 define an inter-blade passage 3 with a neck 8 passing through the exit edge of the blade B, said neck 8 representing the minimal width of the inter-blade passage.

In this inter-blade passage, far from the walls, the flow follows clean flow lines such as the line h. In contact with the inner wall and the outer wall the fluid flow lines are orthogonal to the isobars in directions l and m and vortices are generated when these flow lines impinge on the upper surface of the blade A.

Figure 2:
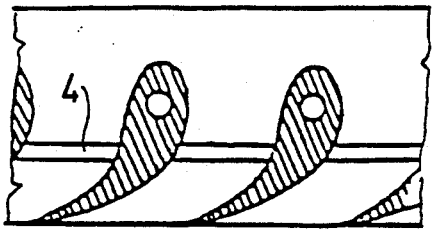
FIG. 2 PRIOR ART
FIG. 2 shows a suction port in a prior art turbine.

FIG. 2 shows a port 4 as disclosed in Japanese patent 52-54807.

The objective of the port 4 in the inner and/or outer wall is to aspirate part of the boundary layer.

Figure 3:
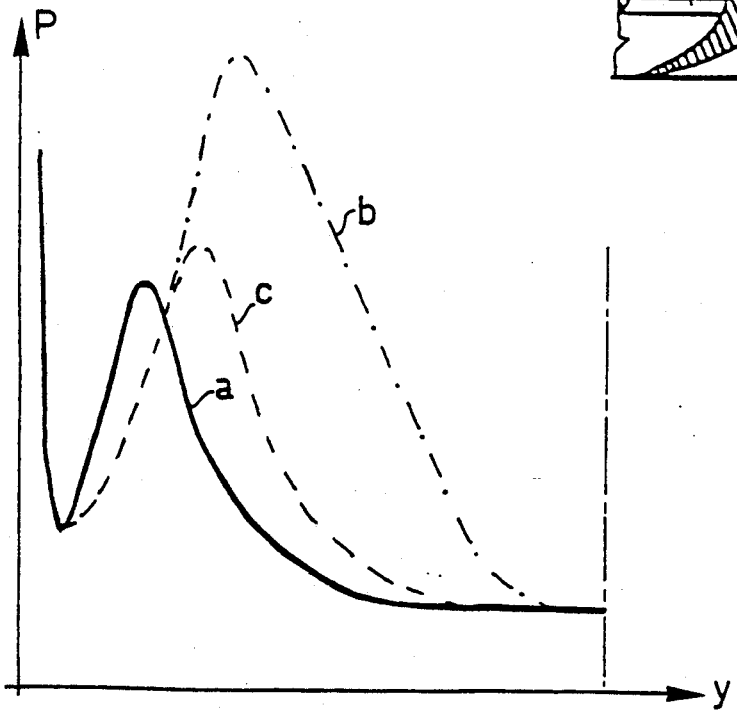
FIG. 3 PRIOR ART
FIG. 3 shows the losses as a function of the distance from the wall in the FIG. 2 turbine.

FIG. 3 is a graph of the local losses P as a function of the distance y from the inner wall 1 or the outer wall 2 of the blade array. The full line curve a shows the losses for an array with no suction in the inter-blade passage. Close to the wall the losses are high because of the boundary layer which forms on this wall. It decreases in the distance away from the wall and then begins to increase again; this represents the losses in the transitional vortex; the losses then decrease again on further movement away from the wall; relatively far from the walls the losses are due only to the boundary layers which develop on the blades.

The curves b and c show the losses for a blade array having a suction port as shown in FIG. 2. When the aspirated flowrate is low, in the order of 0.5% of the total flowrate passing through the blade array, the losses are very significantly increased (curve b). If the aspirated flowrate is increased, the losses are reduced (curve c) but for an aspirated flowrate representing 3% of the main flowrate, a very high figure, the overall loss is still greater than in the blade array with no suction.

The reason for this poor performance is connected with the flow in the suction port. The pressure is not constant along the suction port; at some places in the port, where the pressure is highest, fluid will be effectively aspirated but can be reinjected into the flow at another location in the port where the pressure is lower; this is naturally accompanied by high losses.

Figure 4:
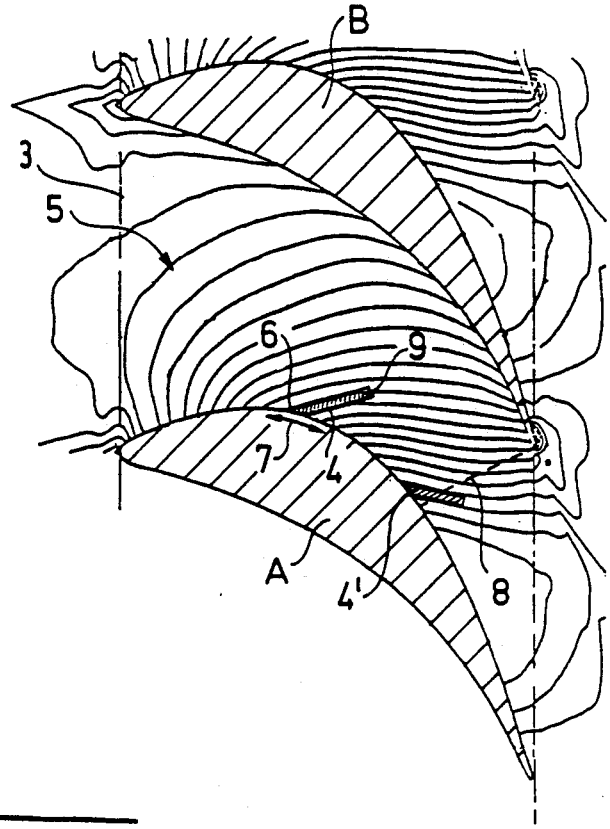
FIG. 4 shows the position of the suction port in accordance with the invention in a stationary blade array.

FIG. 4 shows two extreme positions of the ports in accordance with the invention. In the inter-blade passage 3 defined by the two blades A and B there are shown the isobar pressure lines 5 deduced from a two-dimensional blade array computation. Such calculations (familiar to the man skilled in the turbomachine art) are accurate in respect of the flow sufficiently far from the walls. Near the walls the flow characteristics are very different, with regard to the magnitude and the direction of the fluid velocity, but it is known that the static pressures are only slightly modified relative to the static pressure in a section far from the walls. FIG. 4 shows two extreme positions of the port 4, 4'.

The suction port 4, 4' is disposed near the blade A. Its first end 6 is situated along the upper surface in a region extending from the area 7 of maximum curvature to the neck 8 of the inter-blade passage 3.

The port 4, 4' is rectilinear and runs along an isobar pressure line. Its second end 9 is at a distance equal to one third of the minimum width of the inter-blade passage 3, which is the width of the neck 8. The length of the port is limited to its active part near the upper surface to minimize the aspirated flowrate.

Figure 5:
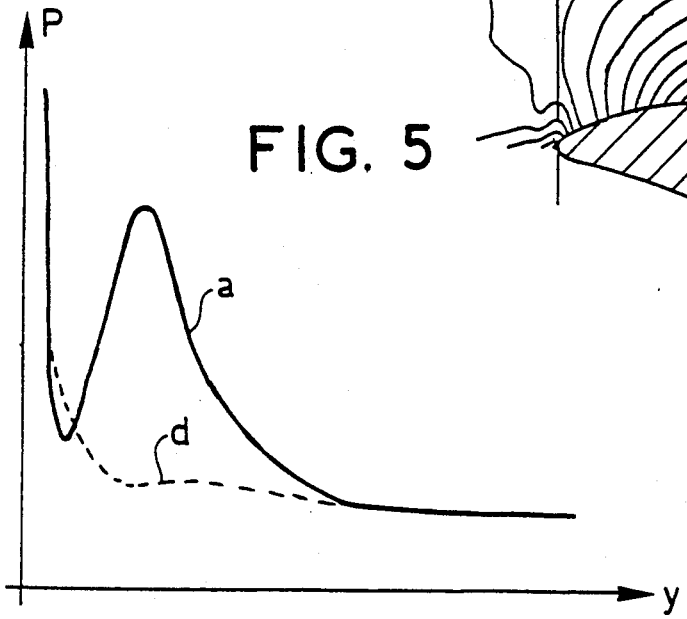
FIG. 5 shows the losses in the FIG. 4 configuration.

FIG. 5 shows the losses P measured with aspiration via a port 4 in accordance with the invention (curve d). A significant improvement is seen in comparison with the losses measured in the absence of any suction device (curve a).

Figure 6:
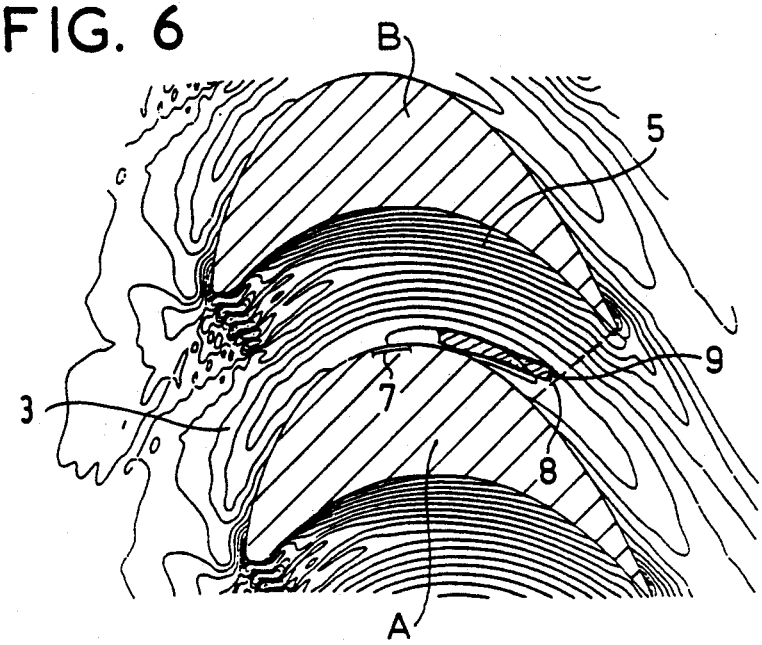
FIG. 6 shows the position of the port in accordance with the invention in a rotary blade array.

FIG. 6 shows the application of the invention to a rotary blade array in which the isobar pressure lines are of somewhat different shape to those of FIG. 4.

Figure 7:
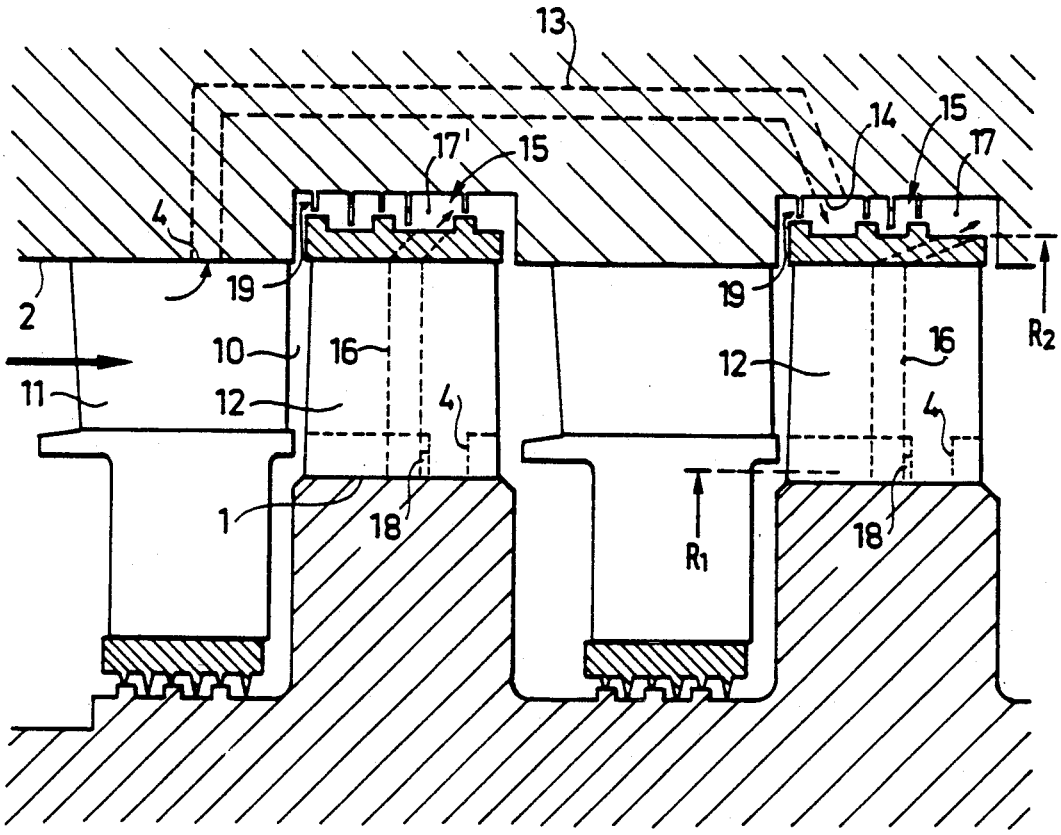
FIG. 7 shows in axial cross-section a turbine comprising blade arrays in accordance with the invention.

FIG. 7 shows two turbine stages 10 each comprising a stationary blade array 11 and a rotary blade array 12. The figure explains how the suction is applied. For the fixed array 11, the suction port 4 is connected by a passage 13 which discharges through an orifice 14 into a chamber of the sealing packing 15 at the outer end of the rotary blade array 12 of the next stage. The high pressure differential across the stationary blade arrays produces the pressure difference needed to achieve suction.

Figure 8:
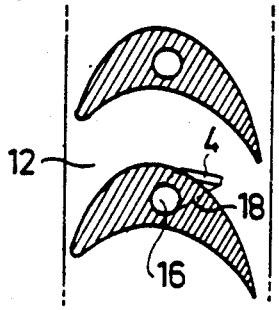
FIG. 8 shows the FIG. 7 turbine in partial horizontal cross-section.

This method cannot be used for the rotary blade array 12, of course. It is hardly possible to apply suction at the outer end of these blade arrays. However, it is possible to achieve suction at the inner end by exploiting the centrifugal effect. A radial (or oblique) conduit 16 is formed in the thickness of the blade to establish communication between the port 4 provided in the inner wall of the passage (radius R1) and the most downstream chamber 17 of the sealing packing at the outer wall (radius R2). Communication between the port 4 and the radial conduit 16 is provided by a connection 18 (see FIG. 8). The centrifugal force $\frac{1}{2}\omega^2(R_2^2-R_1^2)$, in which $\omega$ is the angular velocity, creates the pressure difference which causes the fluid to move from the inner wall towards the outer wall. If the resulting pressure difference is too high, given the required flowrates, the radial conduit 16 can be made to discharge into the penultimate chamber 17' of the sealing packing 15 of the rotary blade array 12, to limit the leakage flowrate 19 through the packing, which flowrate is drawn off from the fluid leaving the stationary blades, and which naturally produces no work. The total flowrate reaching the packing through the orifice 14 or through the conduit 16 is less than or equal to the leakage flowrate that would normally enter the packing in the absence of such suction: virtually all of the improvement due to the reduction in secondary losses is therefore retained.

There is claimed:

1. Turbomachine comprising multiple stages, each stage constituted by a stationary blade array followed by a rotary blade array, each blade array comprising a plurality of circumferentially spaced blades having convex upper surfaces and concave lower surfaces, said blades of each array being disposed between an inner wall and an outer wall, and upper surface of one blade and a lower surface of an adjacent blade of each blade array forming with said inner wall and said outer wall, an inter-blade passage, the outer wall of the rotary blade arrays being provided with a sealing packing defining with a facing part of the rotor, a plurality of chambers, the outer wall of the stationary blade array being provided with a suction port near at leas some of said blades, said port having a first end situated along the upper surface of a blade, in a region extending from a point of maximum curvature of said blade upper surface to a neck of an inter-blade passage between said blade and an adjacent blade, said pot being oriented along an isobar pressure line and said port having a length such that a second end of said port is spaced from the upper surface of said blade by a distance between one quarter and one half the width of the neck of said inter-blade passage, and means for connecting said port to a lower pressure part of the turbomachine.

2. Turbomachine according to claim 1 wherein said port is connected by a passage to a sealing chamber in a downstream part of a sealing packing of a rotary blade array of the next stage.

3. Turbomachine comprising multiple stages, each stage constituted by a stationary blade array followed by a rotary blade array, each blade array comprising a plurality of circumferentially spaced blades having convex upper surfaces and concave lower surfaces, said blades of each array being disposed between an inner wall and an outer wall, an upper surface of one blade and a lower surface of an adjacent blade of each blade array forming with said inner wall and said outer wall, an inter-blade passage, the outer wall of the rotary blade arrays being provided with a sealing packing defining with a facing part of the rotor, a plurality of chambers, the outer wall of the stationary blade array being provided with a suction port near at least some of said blades, said port having a first end situated along the upper surface of a blade in a region extending in the direction from a point of maximum curvature of said blade upper surface to a neck of an inter-blade passage between said blade and an adjacent blade, said port being oriented along an isobar pressure line and said port having a length such that a second end of said port is spaced from the upper surface of said blade by a distance between one quarter and one half the width of the neck of said inter-blade passage, said port being connected by a conduit passing upwardly through said blade and discharging on the downstream side of said packing or in one of the final chambers of said packing.

4. Blade array according to claim 1 wherein the second end of the port is spaced from the upper surface of said blade by a distance approximating one third the width of the neck of the inter-blade passage.

5. Blade array according to claim 3 wherein the second end of the port is spaced from the upper surface of said blade by a distance approximating one third the width of the neck of the inter-blade passage.

* * * * *